United States Patent [19]

Johnson

[11] Patent Number: 4,512,690

[45] Date of Patent: Apr. 23, 1985

[54] FLYING FIGURE TOY GLIDER

[76] Inventor: Mark E. Johnson, 122-C Trellis La., Escondido, Calif. 92026

[21] Appl. No.: 550,796

[22] Filed: Nov. 14, 1983

[51] Int. Cl.[3] ..... A63H 27/00

[52] U.S. Cl. ..... 446/61

[58] Field of Search ..... 46/34, 35, 57, 59, 60–66, 46/68

[56] References Cited

U.S. PATENT DOCUMENTS 3,952,448 4/1976 Kabchef ..... 446/59

4,109,411 8/1978 Wetherell et al. ..... 446/61

4,332,103 6/1982 Shulman ..... 446/64

*Primary Examiner*—F. Barry Shay

*Attorney, Agent, or Firm*—Baker, Maxham, Callan & Jester

[57] ABSTRACT

A toy glider includes a body portion of a low density lightweight construction such as foam having the appearance of a super hero with an opaque cape wing structure and a transparent extended portions of the wing structure attached to the back of the outstretched figure to provide a glider structure giving the appearance of a flying super hero.

17 Claims, 4 Drawing Figures

FIG. 1
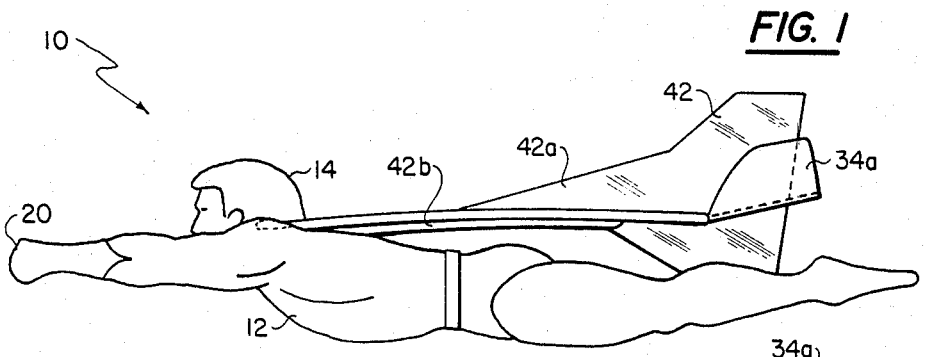
FIG. 2
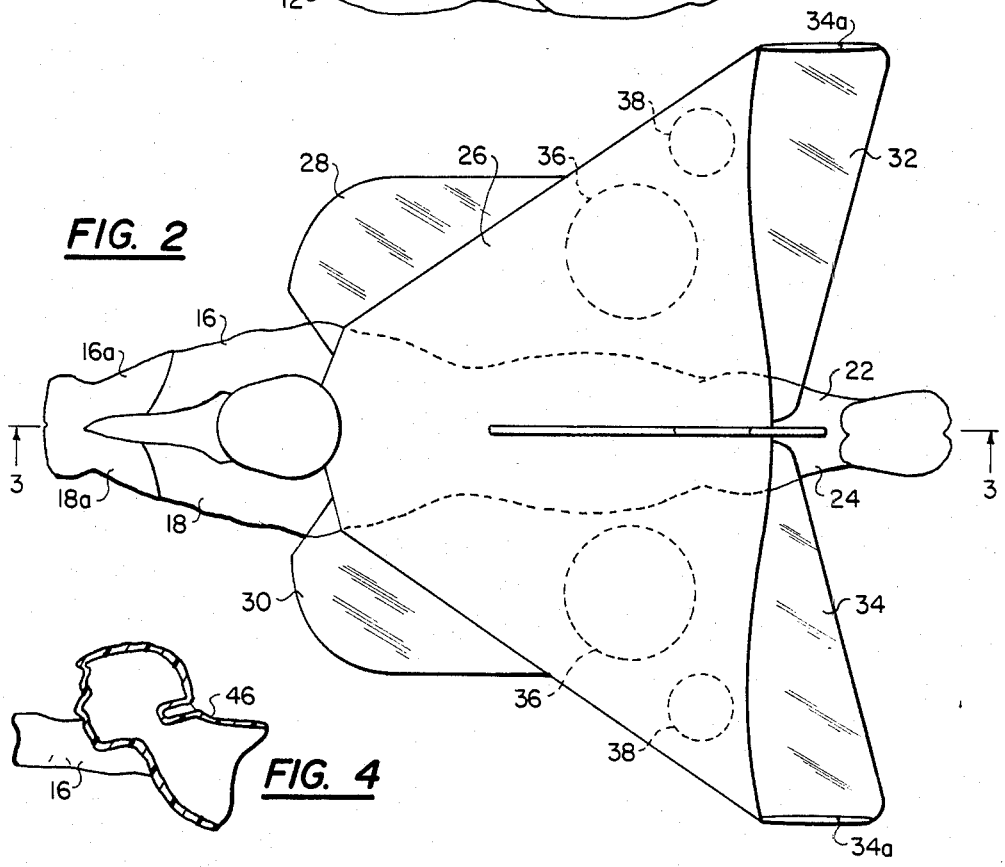
FIG. 4
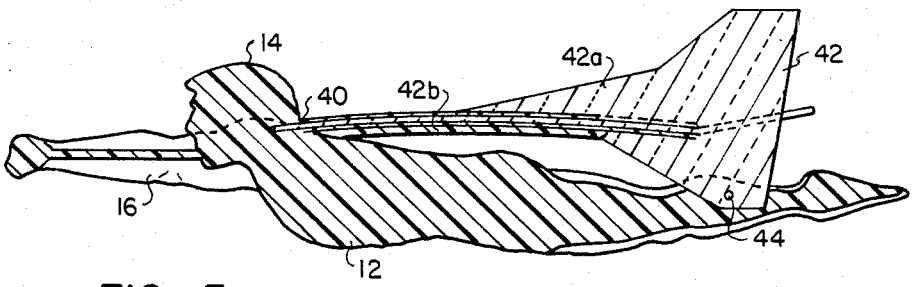
FIG. 3

FLYING FIGURE TOY GLIDER

BACKGROUND OF THE INVENTION

The present invention relates to toys and pertains particularly to a toy glider.

A number of fantasy super heroes have been created particularly in the comic strips and in comic books to which many children readily relate. These figures, which include such heroes as "Superman", "Captain Marvel", "Superwoman", "Mightly Mouse", and others wear a cape and in their world of fantasy have the capability of flying through the air. Some attempts have been made in the past to make gliders of such figures. These, however, have been unsuccessful due to the inadequate support capability of the wing structure of the cape configuration.

Toy glider construction has found to require very critical wing area and structure and very critical weight-to-balance ratios. While many materials are available for the construction of gliders, few are available which provide the optimum structural integrity and weight combination in order to achieve the desired structure.

Other problems in the construction of toy gliders, particularly in the formation of gliding super heroes, have failed to develop adequate wing structure of the caped configuration.

It is therefore desirable that improved toy gliders be available which simulate super hero figures.

SUMMARY AND OBJECT OF THE INVENTION

It is therefore the primary object of the present invention to provide an improved toy glider simulating the appearance of a super hero.

In accordance with the primary aspect of the present invention, a toy glider is constructed to provide the appearance of a super hero in flight with a lightweight outstretched body structure supported by a primary opaque caped winged configuration with transparent wing extensions to provide adequate wing support and including transparent vertical stabilizer.

BRIEF DESCRIPTION OF THE DRAWINGS

The above and other objects and advantages of the present invention will become apparent from the following description when read in conjunction with the drawings wherein:

FIG. 1 is a side elevation view of a preferred embodiment of the invention shown in flight;

FIG. 2 is a top plan view of the embodiment of FIG. 1;

FIG. 3 is a section view taken generally on line 3—3 of FIG. 1; and

FIG. 4 is a partial view, like FIG. 3, showing an alternate embodiment.

DETAILED DESCRIPTION OF A PREFERRED EMBODIMENT

Referring to the drawings, a toy glider in accordance with the invention is designated generally by the numeral 10 and comprises a body 12 of a lightweight construction, such as a styrofoam or the like, or combinations of styrofoam and a sponge foam or the like, or a hollow body construction as will be described. The body 12 is formed in the configuration of a super hero, such as many of the human-like figures such as "Superman", "Superwoman", "Captain Marvel" or the the animal figures, such as "Mighty Mouse" and the like. While the male human figure super hero is illustrated, it is to be understood that the figure can include the male and female of any of the human-like figures as well as any of the animal figures. The body includes, in the illustrated embodiment, a head 14 with forwardly outstretched arms 16 and 18 joined together at a forward tip or end 20. The arms include forward portions **16*a* and 18*a* which include a resiliency such as a rubberized or resilient sponge foam construction to absorb the shock of the figure or glider as it strikes an object or the ground. The forward limbs 16 and 18 are in the form of arms for the illustrated embodiment. Rearwardly, or rear limbs, in the illustrated embodiment include legs 22 and 24** which are outstretched toward the rear along the longitudinal axis of the body.

The body 12 is preferably colored or painted in a fashion to simulate the clothing and dress of the particular super hero which forms the basis of the glider.

A wing structure for the figure is constructed of a sandwich construction having a primary or opaque cape configuration 26 which, as can be seen in FIG. 2, has a somewhat triangular outstretched cape configuration. This portion of the wing structure is preferably opaque and has the color and configuration of the cape of the particular super hero when the cape is in the outstretched flying configuration for the particular figure. In order to improve the flying capability of the figures, in accordance with the invention, forwardly extending transparent extensions 28 and 30 extend forward of the leading edge of the cape portion 26 to extend and expand the wing area of the figure. Additional trailing transparent wing extensions 32 and 34 are provided to further increase the wing surface area and to provide, as can be seen in FIGS. 1 and 3, a somewhat trim tab construction. With this wing construction, the transparent portions 28, 30, 32 and 34 essentially disappear from view as the figure flies through the air giving the distinct impression of the super hero in flight supported solely by his visible cape 26.

In a preferred form of the wing construction, a sheet of clear polycarbonate of about 0.020 in thickness forms at least the extensions 28, 30, 32 and 34 and is sandwiched between two thin layers or sheets of polystyrene or like foam, as can be seen in FIG. 3. As shown in FIG. 3, the sheet of clear polycarbonate forms the outer edges of the entire wing structure with portions of the leading edges of the styrofoam layer and the polycarbonate layer essentially coinciding at a portion of the leading edge. The sheet portion of the wing construction can be considerably reduced in its actual area of total material by such techniques as removing portions thereof, such as circular or other cutouts 36 and 38 in areas where the outer surface of the wings are formed by the styrofoam layers. This reduces the weight of the wing structure by reducing the total area of the higher density sheet.

The wing structure is attached to the back of the figure, at the back of the neck of the figure, such as by bonding or by insertion of an edge in a slot as may be desired.

A vertical stabilizer 42 which is also preferably of a clear transparent polycarbonate is attached at the center of the figure and the wing structure and is aligned vertically and along the axis of the figure. This vertical stabilizer may be attached to the body structure by any suitable form of bonding, gluing, or the like, such as in a slot between aft of the leg structure at 44. The vertical stabilizer may, in some instances, be omitted where adequate wing structure and an adequate dihedral may be formed in the wing structure. However, the vertical stabilizer will in most instances be required in order to enable a more realistic configuration of the wing and simulated cape structure.

Referring to FIG. 4, an alternate construction of the body may be accomplished by blow molding wherein a figure or body 46 of a thin sheet of polyethylene may be formed in the body shape in a blow molding technique. This provides a lightweight construction which also provides a suitable low density flying glider body.

The forwardly extending arms of the figure may in both instances by formed of a separate rubber bumper with at least the front portion which forms the gloves is disclosed as being in the rubber bumper construction. An alternate construction can include reinforcement of the arm structure by a reinforcing beam of a suitable lightweight structure material, such as balsa wood or the like.

While I have illustrated and described my invention by means of specific embodiments, it is to be understood that numerous changes and modifications may be made therein without departing from the spirit and scope of the invention as defined in the appended claims.

I claim:

1. A toy flying figure glider, comprising:

a lightweight body formed in an outstretched configuration having a head, a pair of forwardly extending forward limbs, and a pair of rearwardly extending rear limbs, a wing structure attached to the back of said body for supporting said body in flight in an airborne configuration, and said wing structure comprising an opaque portion, said portion being arranged to have symmetry with respect to the length of the body, providing a wing area and simulating an outstretched cape worn by the body, and transparent means for inconspicuously expanding said wing area, said transparent means extending beyond the edges of said opaque portion and continuing said symmetry.

2. The flying figure of claim 1 wherein said figure is that of a human.

3. The flying figure of claim 1 wherein said figure is that of an animal.

4. The flying figure of claim 1 wherein said transparent means includes a portion extending forward of said opaque portion; and further comprising a portion extending behind said opaque portion.

5. The flying figure of claim 1 wherein said transparent means includes a portion extending behind said opaque portion.

6. The flying figure of claim 1 including a transparent vertical stabilizer.

7. The flying figure of claim 1 wherein said opaque portion of said wing structure is constructed of foam.

8. The flying figure of claim 1 wherein said body is constructed of foam and said forwardly extended limbs are constructed of a yieldable rubber.

9. The flying figure of claim 7 wherein said wing structure is formed of a sandwich construction.

10. The flying figure of claim 1 wherein said body is hollow plastic formed by a blow molding technique.

11. A toy figure glider comprising:

an elongated body depicting a living figure having a head and at least a pair of legs, said body made of a lightweight plastic construction having a pair of front limbs rigidly secured thereto and extending beyond the head along the longitudinal axis thereof and a pair of rear limbs with feet on the outer end thereof extending along the axis thereof in the rearward direction;

a wing assembly secured to the back of said body and having an opaque portion, said portion being arranged to have symmetry with respect to the length of the body, providing a wing area and simulating an outstretched cape worn by the body, and transparent means for inconspicuously expanding said wing area, said transparent means extending beyond the edges of said opaque portion and continuing said symmetry; and a transparent vertical stabilizer.

12. The flying figure of claim 11 wherein said transparent means includes a portion extending forward of said opaque portion; and further comprising a portion extending behind said opaque portion.

13. The flying figure of claim 12 wherein said opaque portion of said wing assembly is constructed of foam.

14. The flying figure of claim 13 wherein said body is constructed of foam and includes forwardly extended limbs constructed of a yieldable rubber.

15. The flying figure of claim 14 wherein said wing assembly is formed of a sandwich construction.

16. The flying figure of claim 15 wherein said figure is that of a human.

17. The flying figure of claim 11 wherein said figure is that of an animal.

* * * * *